US005439037A

United States Patent [19]

Christe

[11] Patent Number: 5,439,037

[45] Date of Patent: Aug. 8, 1995

[54] WEFT THREAD DISTRIBUTION DEVICE FOR A SERIES SHED LOOM

[75] Inventor: Marcel Christe, Rüti, Switzerland

[73] Assignee: Sulzer Rueti AG, Rueti, Switzerland

[21] Appl. No.: 239,100

[22] Filed: May 6, 1994

[30] Foreign Application Priority Data

May 13, 1993 [EP] European Pat. Off. ..... 93810352

[51] Int. Cl.[6] ..... D03D 47/30

[52] U.S. Cl. ..... 139/28; 139/11

[58] Field of Search ..... 139/28, 11, 188 R, 436

[56] References Cited

U.S. PATENT DOCUMENTS

| | | | |
|---|---|---|---|
| 3,768,213 | 10/1973 | Asano | 51/165.78 |
| 4,388,951 | 6/1983 | Atkinson | 139/11 |
| 4,586,541 | 5/1986 | Steiner | 139/28 |
| 4,592,393 | 6/1986 | Steiner | 139/11 |
| 5,146,955 | 9/1992 | Steiner et al. | 139/450 |

FOREIGN PATENT DOCUMENTS

| | | |
|---|---|---|
| 0143119 | 6/1985 | European Pat. Off. . |
| 0433216 | 6/1991 | European Pat. Off. . |

*Primary Examiner*—Andrew M. Falik

*Attorney, Agent, or Firm*—Townsend and Townsend Khourie and Crew

[57] ABSTRACT

A device for the distribution of weft yarns into weft ducts of a rotor of a series shed loom has a first part (7) rotating with the rotor (2) with transfer ducts (11) for the weft yarns and a second part (8) which is nonrotatable in relation to the rotor (2) and has connecting ducts (10) for the weft yarns. Between the first and second parts (7, 8) are three support units (30) which form a three-point support and keep the first and second parts (7, 8) spaced apart to define a gap (9) between them. This reduces friction between the first and second parts (7, 8) and improves the transfer and distribution of the weft threads.

8 Claims, 3 Drawing Sheets

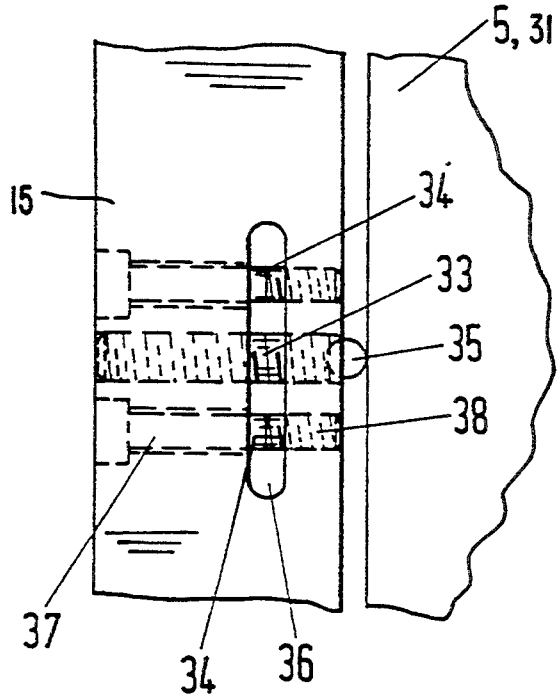
Fig.2
Fig.3
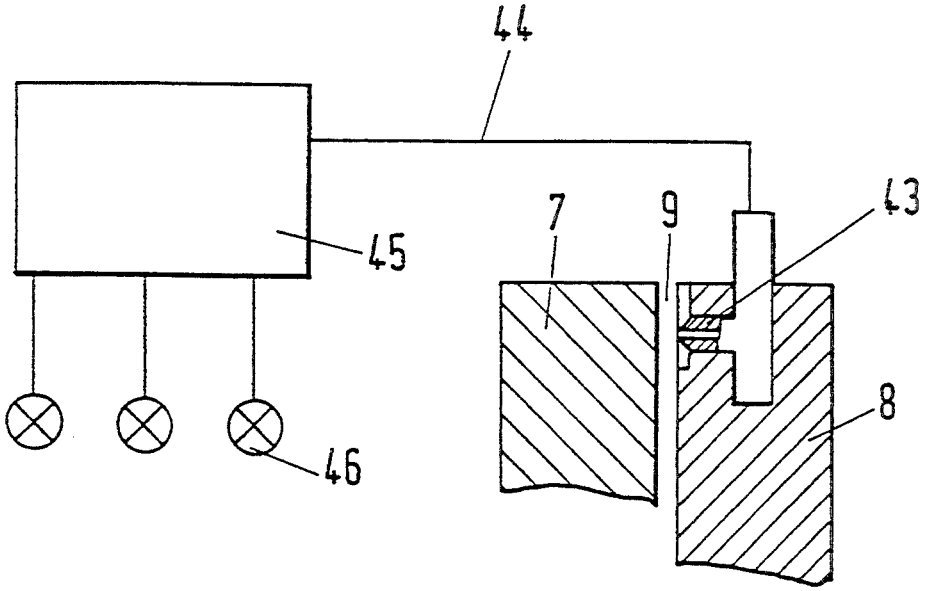

WEFT THREAD DISTRIBUTION DEVICE FOR A SERIES SHED LOOM

BACKGROUND OF THE INVENTION

The present invention relates to a device for the distribution of weft threads and also to a series shed loom having such a weft thread distribution device. Published European patent application EP-A-433 216 discusses a device for the distribution of weft threads which comprises a fixed part and a part rotating with the rotor, which in a rotationally symmetrical face possess a common separating and sealing face, via which the transfer of weft threads occurs, whereby the surface portions designed as sealing faces touch with a pressure produced by energy storing devices in order to perform, with low acceleration forces, the distribution of the weft threads and their transfer to the different weft ducts of a rotor.

This device has the great disadvantage that higher wear occurs because of the touching sealing faces and the sealing faces present do not meet requirements, so that the transfer of weft threads is not performed faultlessly.

SUMMARY OF THE INVENTION

An object of the present invention is to create a device for the distribution of weft thread which does not have the disadvantage mentioned above.

This object is achieved according to the invention by providing at least three support units forming a three-point support between the apposing faces of the fixed and rotating parts to keep the faces spaced apart and define a gap between them.

BRIEF DESCRIPTION OF THE DRAWINGS

FIG. 2 is a fragmentary view taken along line 2—2 of FIG. 1 and shows an adjustable support unit for a second part, FIG. 3 shows a diagrammatical representation of a gap monitoring mechanism by means of a dynamic pressure sensor nozzle and differential pressure switches.

DESCRIPTION OF THE PREFERRED EMBODIMENT

Figure 1:
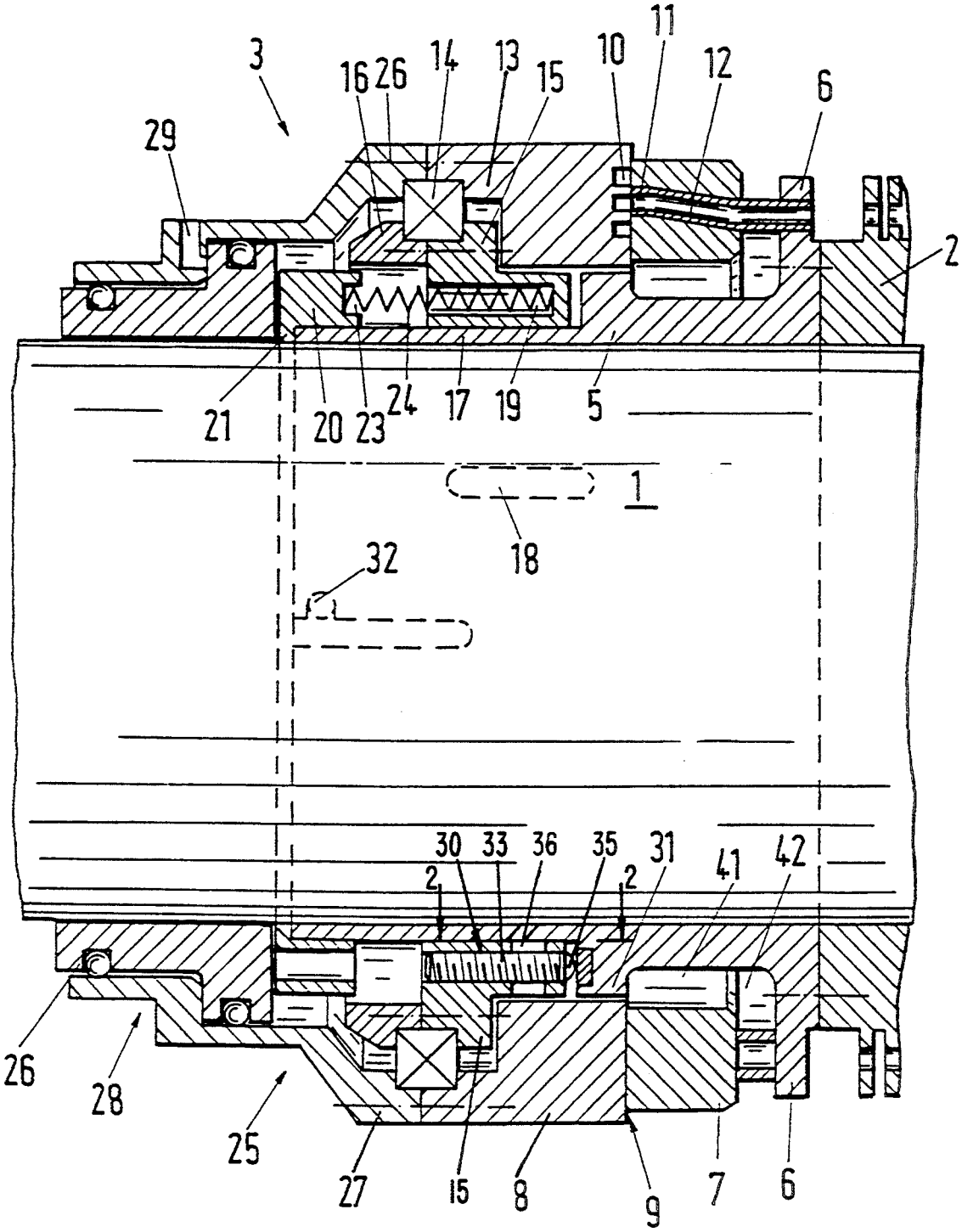
FIG. 1 shows a section of an embodiment of a device made according to the invention in its operating position.
Figure 4:
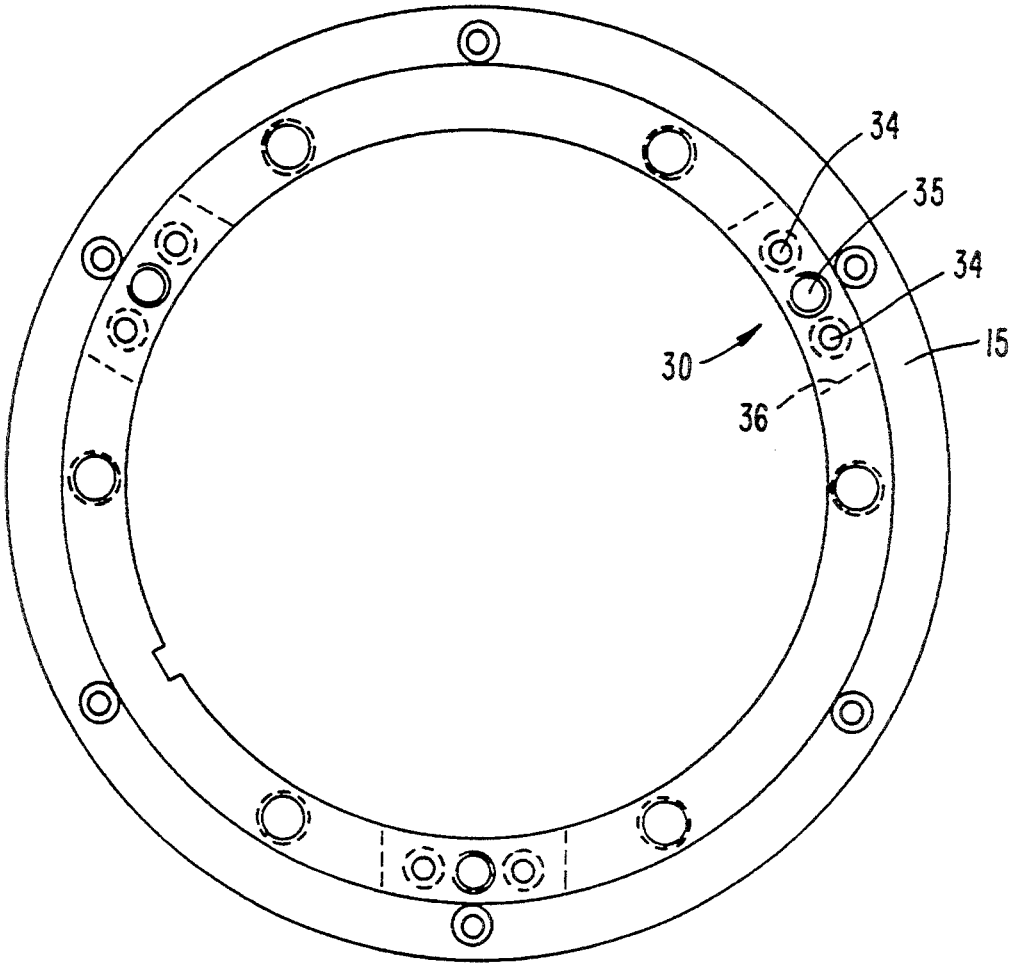
FIG. 4 is an end view of the ring which mounts the adjustable support unit shown in FIG. 2.

FIG. 1 shows a portion of a series shed loom having a shaft 1, a rotor 2 and a device for the distribution of the weft threads.

The device comprises a substantially tubular housing part 5 having a flange 6, which is attached to the rotor 2 and rotates with the rotor 2.

The device contains an annular first part 7, which is attached to the flange and rotates with the rotor 2, and an annular second part 8, which is fixed with respect to the first part 7, which parts are disposed coaxially to one another and spaced from one another so that there is a gap 9 between the front faces lying opposite one another in order to avoid friction between them.

To perform the distribution of the weft threads, the opposite front sides of the first and second parts 7, 8 includes channel-shaped recesses 10, 11 which are open to the front side in the form of arcs of circles. The recesses in the first part 7 are connected via a duct 12 to the rotor 2, while the recesses 10 in the second part 8 are connected via ducts (not represented) with thread supply devices (not represented either).

Between the annular first part 7 and the flange 6 on the one hand and the periphery of the housing part 5 on the other hand there are a radial and an axial recess 41 and 42. This measure effects an automatic removal of fiber fluff (FIG. 1).

In order to maintain and adjust the gap 9, the second part 8 is provided with three support units 30, which thus form a three-point support and abut a shoulder 31 on the housing part 5. At the support point is disposed an insert member 32 made from hard metal.

As FIG. 2 shows, the support unit 30 consists of a supporting screw 33 and a ball 35, which is rotatably held at the free end of the supporting screw 33. The supporting screw 33 is screwed into a threaded bore (not represented) so that the ball 35 protrudes from the threaded bore. With the supporting screw 33 is associated an arrangement which includes two straining screws 34 and a slot 36, and which is provided at the point on ring bearing 15 provided for the three-point support. The slot 36 penetrates the ring bearing 15 in the radial direction. The dimensions of the slot 36 are such that both the supporting screws 33 and also the straining screws 34 pass through the slot in the axial direction. The straining screws 34 are disposed on both sides of the supporting screws 33 and adjacent to the screw head comprise a shaft 37 and at the free end a threaded portion 38, which have such dimensions that the transfer portion of the thread lies inside the slot 36. After the adjustment of the supporting screw 33 the slot can be deformed by means of the straining screws 34, i.e. its width can be reduced, as a result of which the clearance between the turns of the threaded bore in the ring bearing and the supporting screw screwed into it is abolished. In this manner a perfect and exact adjustment of the gap 9 with respect to the gap width and plane parallelism between the first and second parts 7, 8 is guaranteed, and the supporting screw 33 is fixed and secured.

By the removal of the clearance between the turns a precise adjustment of the gap between the first and second parts 7, 8 in the magnitude of 0.01 mm is advantageously made possible and is maintained because play has been eliminated and the supporting screws 33 are therefore fixed. As a result a faultless supply of weft threads is guaranteed with little air loss.

The second part 8 is pivoted via an operating mechanism 3 on housing part 5. For this purpose on the second part 8 is constructed a projection 13, into which a rolling bearing 14 is inserted. The rolling bearing 14 is carried on ring bearing 15 and is retained thereon by means of a ring 16.

The housing part 5 has a cylindrical projection 17 on its end opposite the flange 6. The ring bearing 15 is disposed in an axially displaceable manner on this projection and is prevented from twisting by a wedge guide 18. This wedge guide 18 is at the same time used to guide operating device 3 with the second part 8 during the axial displacement. In the ring bearing 15 are constructed six blind holes 19, which are equally spaced along on a circular line. On the free end of the projection 17 is a clamping ring 20 which has a radially inwardly directed projection 21. The projection 21 of the clamping ring 20 abuts the front end of projection 17 and is secured by a pin 22, which is disposed in the Clamping ring 20 and protrudes into a recess in the projection 17. Clamping ring 20 includes blind holes 23 which are aligned with blind holes 19 in the ring bearing 15. Pressure springs 24 in blind holes 19, 23 retain the second part 8 connected to the ring bearing 15 in the operating position.

To displace the second part 8, the operating mechanism 3 comprises a piston arrangement having a housing part 25 and a piston 26. The housing part 25 is substantially a hollow cylinder with a first portion 27, which is bolted to the second part 8 and mounted on the rolling bearing 14, and a second portion 28 in which the piston 26 is disposed so that it can move up and down.

The piston 26 has a hollow cylindrical portion having a sealing ring on the periphery and at one end a flange with a sealing ring on the periphery. The second portion 28 has two partial portions with different internal diameters so that there is a shoulder in which an inlet duct 29 is constructed. The piston 26 is disposed so that the sealing rings disposed at the hollow cylindrical section and at the flange tightly abut the inner faces of the partial portions and with the shoulder form an annular operating chamber into which the inlet duct 29 opens.

To assure a faultless distribution of the weft threads, in a series shed loom having such a device there is provided a mechanism to monitor the width of the gap 9 between the first and second parts 7 and 8, which is shown in FIG. 3.

As FIG. 3 shows, in the fixed part 8 is disposed a sensor nozzle 43 which is supplied with air and which is part of a dynamic pressure sensor mechanism. The sensor nozzle (43) is disposed outside the connecting ducts (10) in the second part (8), and discharges an air stream into gap (9). First and second signal generators are operatively coupled with the sensor nozzle (43), and indicating elements (46) connected with the signal generator are provided for indicating predetermined pressure states. A change in the width of the gap 9 produces a change in the dynamic pressure. A change in the dynamic pressure ensures that the differential pressure switches switch over at predetermined pressure values and trigger electrical signals.

What is claimed is:

1. A device for the distribution of weft threads into weft ducts of a rotor of a series shed loom, the device comprising a first part (7) rotating with the rotor (2) and having a number of transfer ducts (11) for the weft thread supply, a second part (8) rotatable with respect to the rotor having a number of connecting ducts (10) for the weft thread supply, at least one rolling bearing (14) coaxially mounting the first and second parts, means biasing the first and second parts in an axial direction towards each other into an operating position, and at least three support units (30) forming an at least three-point support between the first and second parts (7, 8) and keeping the first and second parts spaced apart to create a gap (9) between them.

2. A device according to claim 1 wherein the support units (30) are adjustable for varying a width of the gap (9).

3. A device according to claim 1, wherein each support unit (30) includes means for eliminating play within the support unit and securing it in a predetermined position.

4. A device according to claim 1 wherein the support units (30) include means for nonrotatably connecting them with the first part (7).

5. A device according to claim 1, wherein the rolling bearing (14) includes one of a cross roller bearing and a thin ring ball bearing to effect a play-free interaction of the first and second parts (7, 8).

6. A series shed loom including a supply of weft yarns, a rotor, an air jet picking system for the weft yarns, a first part rotating with the rotor and having a number of transfer ducts for the weft yarn, a second part rotatable with respect to the rotor having a number of connecting ducts for the weft yarns, the first and second parts including opposing faces, a bearing coaxially and rotatably mounting the first and second parts, means urging the first and second parts in an axial direction towards each other into an operating position, and at least three support units forming an at least three-point support between the first and second parts and keeping the faces thereof spaced apart to form a gap between them.

7. A series shed loom according to claim 6 including a dynamic pressure sensor for monitoring dynamic pressure in the gap between the faces of the first and second parts.

8. A loom according to claim 7 wherein the sensor comprises a sensor nozzle disposed outside the connecting ducts in the second part and through which an air stream discharges into the gap (9), first and second signal generators operatively coupled with the sensor nozzle, and indicating elements (46) connected with the signal generator for indicating predetermined pressure states.

* * * * *